United States Patent [19]

Newman et al.

[11] Patent Number: 4,978,024

[45] Date of Patent: Dec. 18, 1990

[54] CONTAINER LID

[75] Inventors: Alec T. Newman, Banbury; John Zeller, Northants, both of United Kingdom

[73] Assignee: General Foods Limited, Banbury, United Kingdom

[21] Appl. No.: 426,370

[22] Filed: Oct. 24, 1989

[30] Foreign Application Priority Data

Nov. 4, 1988 [GB] United Kingdom ..... 8825836.3

[51] Int. Cl.[5] ..... A47G 19/22

[52] U.S. Cl. ..... 220/90.4; 220/90.2; 220/90.6; 220/380; 220/356; 206/508

[58] Field of Search ..... 220/90.2, 90.4, 90.6, 220/352, 355, 356, 380; 215/307, 309, 100 R, 1 R, 1 A; 229/906.1; 222/570, 192; 206/508

[56] References Cited

U.S. PATENT DOCUMENTS

| | | | |
|---|---|---|---|
| 962,641 | 6/1910 | Kaufmann | 220/90.2 |
| 2,550,568 | 4/1951 | Kersh | 128/252 |
| 2,646,193 | 7/1953 | Best | 222/570 |
| 2,786,614 | 3/1957 | Giusto | 222/570 |
| 3,980,213 | 9/1976 | Ramsay | 222/485 |
| 3,989,142 | 11/1976 | Gwilliam, Jr. et al. | 206/508 |
| 4,047,329 | 9/1977 | Holt | 220/306 X |
| 4,275,815 | 6/1981 | Davis | 206/508 |
| 4,366,914 | 1/1983 | Ingram | 220/287 |
| 4,394,928 | 7/1983 | Philip | 220/366 |
| 4,460,103 | 7/1984 | Rama et al. | 220/254 |
| 4,518,096 | 5/1985 | Winstead | 220/268 |
| 4,589,569 | 5/1986 | Clements | 220/380 |
| 4,753,365 | 6/1988 | Seppala | 220/90.4 |
| 4,756,440 | 7/1988 | Gartner | 220/90.4 |
| 4,785,931 | 11/1988 | Weir et al. | 206/222 |
| 4,828,141 | 5/1989 | Coy | 220/380 |

*Primary Examiner*—Stephen Marcus
*Assistant Examiner*—Stephen K. Cronin
*Attorney, Agent, or Firm*—Linn I. Grim

[57] ABSTRACT

The present invention discloses a lid for a drinking cup, which comprises a base portion having an upstanding collar formed around the periphery thereof, the collar having an inner wall terminating in a rim provided with at least one orifice adapted, in use, for a beverage to be drunk therethrough, and having a skirt extending downwardly from the rim which, in use, is adapted to frictionally engage the rim of a cup containing the beverage, and the base portions being provided with a hole adapted, in use, for the introduction of the beverage and/or beverage making ingredients therethrough.

9 Claims, 1 Drawing Sheet

CONTAINER LID

The present invention relates to a container lid and, in particular to an anti-splash lid for a drinking cup.

Plastic and paper cups are used in a number of catering and vending situations for the dispensing and/or sale of hot and cold beverages. Often the location at which the beverage is dispensed and/or sold is remote from the location at which the consumer intends to drink the beverage. There is thus a significant possibility that some or all of the beverage will be spilled in transporting it. Lids are thus often supplied with such beverages at the location at which they are dispensed and/or sold, these lids generally being of the type which snap fit onto the rim of the cup and thus being somewhat troublesome to remove from the cup before the beverage can be drunk. Furthermore, once the lid has been removed from the cup the beverage in the cup can splash out of the cup, which is a particular hazard if the beverage is being drunk in a transport situation, for example on a train, coach or aircraft.

We have now developed an anti-splash lid for a cup which helps to prevent spillage when transporting a beverage in the cup to the location at which the beverage is to be drunk and which helps to prevent the beverage splashing out of the cup when it is being drunk.

Accordingly the present invention provides a lid for a drinking cup, which comprises a base portion having an upstanding collar formed around the periphery thereof, the collar having an inner wall terminating in a rim provided with at least one orifice adapted, in use, for a beverage to be drunk therethrough, and having a skirt extending downwardly from the rim which, in use, is adapted to frictionally engage the rim of a cup containing the beverage, and the base portion being provided with a hole adapted, in use, for the introduction of the beverage and/or beverage making ingredients therethrough.

The lid of the present invention is, in use, located onto a cup which is to contain the beverage. The lid may either snap fit over the rim of the cup or may be provided, at the free end of the skirt of the collar, with means to lock or fasten the lid onto the rim of the cup, or onto a suitable holder for the cup. For example, the skirt may be provide with one or more male features which interlock with corresponding female features provided on the rim of the cup. Alternatively, a keying feature on the skirt of the collar could engage a locking feature provided on the rim of the cup.

The lid of the invention is provided with at least one orifice in the rim of the collar, preferably a single elongate orifice, through which the beverage in the cup to which the lid is fitted is drunk. It will be understood that the orifice or orifices should be of suitable dimensions to drink through. The orifice(s) formed in the collar may, if desired, be provided with a protective peelable cover in order to ensure that the orifice is completely hygenic prior to use.

The collar which surrounds the base portion of the lid preferably stands at least one inch above the base portion, thereby forming a dish or recess into which the nose of the beverage drinker will fit without any discomfort.

The collar is also preferably provided, adjacent the rim thereof, with means adapted, in use, to frictionally engage the sidewall of a cup stacked therein. In this manner several cups may readily be carried by one person without difficulty. For example, the collar may be provided on the inner wall thereof with a plurality of bosses which then bear against the sidewall of a cup stacked in the lid.

In use, the lid of the present invention is preferably located on a cup before the beverage is put into or made in the cup. The cup may be filled by introducing a prepared beverage, such as tea or coffee, into the cup through the hole in the base portion and adding any other ingredients as desired. Alternatively, the beverage may be made in the cup by introducing, for example, instant coffee or a tea bag into the cup through the hole in the base portion and adding hot water thereto. Cream, milk and/or sugar are then added to the beverage according to taste. The hole in the base portion is thus preferably sufficiently large to enable a tea bag to be put into the cup for the preparation of tea and to be withdrawn from the cup when the tea has reached the required strength. Furthermore, a stirrer for stirring the beverage can be introduced through the hole The lid may, alternatively, be placed over a cup filled with beverage ingredients. In this instance the hole in the base portion of the lid may be provided with a peelable cover.

The base portion is preferably inclined towards the hole formed therein so that any liquid splashing out through the hole runs back into the cup. The hole in the base portion is preferably also provided with a downwardly turned skirt surrounding at least a portion of the periphery thereof in order to prevent splashing. Preferably the skirt totally surrounds the hole.

The portion of the rim of the collar in which the orifice(s) is are formed may be raised above the rest of the rim so as to facilitate drinking from the cup and this is of particular importance for those people with drinking difficulties, such as the elderly or the infirm.

In use, if the cup to which the lid is attached is overfilled then the excess liquid will run up against the collar adjacent the section in which the orifice(s) is are formed when the cup is tilted and the consumer will drink this liquid as if from a normal cup or glass in addition to the liquid which comes through the orifice(s).

The lid of the present invention may be made from any suitable material such as paper, card, plastic coated card or a plastics material. Preferably, it will be made from the same material as the material of the cup with which it is intended to be used. The lid of the invention may be manufactured by stamping or pressing paper or card, or by injection moulding, thermoforming or vacuum forming a plastics material.

The present invention will be further described with reference to the accompanying drawings, in which.

Figure 1:
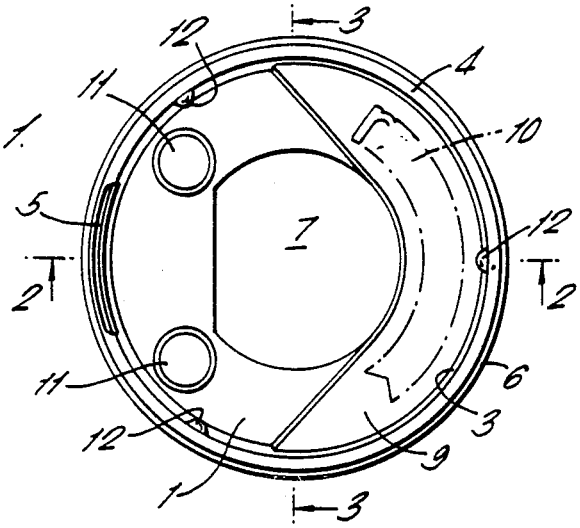
FIG. 1 is a plan view of a lid according to the invention.
Figure 2:
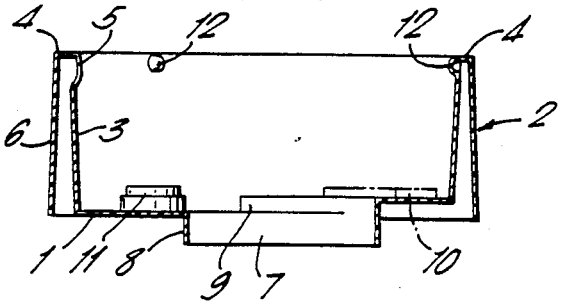
FIG. 2 is a section of the lid of FIG. 1 taken along the line 2—2 of FIG. 1.
Figure 3:
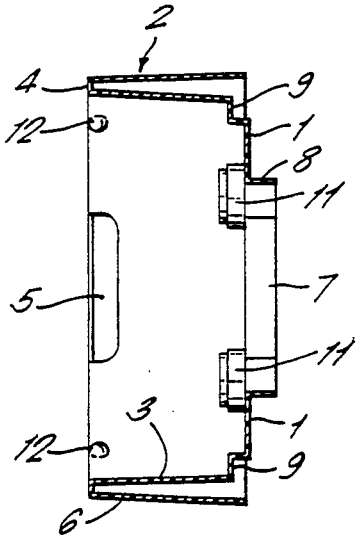
FIG. 3 is a section of the lid of FIG. 2 taken along the line 3—3 of FIG. 1.

Referring to the drawings, a cup lid according to the invention is shown in plan view in FIG. 1. The cup lid comprises a base portion 1, which has an upstanding collar 2 formed around the periphery thereof. The upstanding collar has an inner wall 3 which terminates in a rim 4. The rim 4 of the collar has an orifice 5 formed therein which is generally of elongate form. The orifice 5 is cut out of the rim 4 and inner side wall 3 of the collar. The collar 5 also has a skirt 6 depending from rim 4, the skirt 6 being adapted to frictionally engage the rim of a cup (not shown) onto which the lid fits. The base portion 1 of the lid has a generally circular hole 7 formed therein, the hole having a depending skirt 8 formed around the periphery thereof. The hole 7 is intended to be used either for pouring a ready prepared beverage into the cup, or for the insertion of beverage ingredients into the cup. The beverage may also be stirred through the hole 7 and any unwanted beverage ingredients such as tea bags, coffee bags or lemon slices, etc. removed therethrough.

In the embodiment of the lid as shown in the accompanying drawings, one portion 9 of the base portion 1 is raised. A further feature 10 provides and additional raised area onto which advertising material etc., may be printed, or which may be formed by embossing portion 9. The base portion is then provided with studs 11 so that the base of another cup placed in the lid will be level. The collar 2 of the lid is also provided adjacent the periphery of the rim 4 with a plurality of bosses 12 which project from the inner wall 3 of the collar. The bosses 12 provide a means for gripping the base of another cup stacked in the lid. The base portion of the lid is also inclined towards the hole 7 so that any liquid splashed onto the surface thereof will drain back into the cup onto which the lid is fitted through hole 7.

The collar 2 is raised about 1 inch above the base portion 1 of the lid. In this manner, when a beverage is drunk from a cup (not shown) through orifice 5 by tilting the cup, an adequate recess is provided for nose intrusion, without causing discomfort to the consumer.

We claim:

1. A lid for a drinking cup, whereby said lid comprises a base portion having an upstanding collar formed around the periphery thereof, said collar terminating in a rim provided with at least one orifice adapted, in use, for a beverage to be drunk therethrough, said collar having, adjacent the interior of said rim, means adapted, in use, to frictionally engage the sidewall of a first cup stocked therein, and having a skirt extending downwardly from said rim which, in use, is adapted to frictionally engage the rim of a second cup containing the beverage, and said base portion being provided with a hole adapted, in use, for the introduction of a beverage and/or beverage making ingredients therethrough.

2. A lid as claimed in claim 1 wherein a single orifice of elongate form is provided in the rim of said collar.

3. A lid as claimed in claim 2 wherein said collar is upstanding above the base portion of said lid by at least one inch.

4. A lid as claimed in claim 3 wherein the means to frictionally engage the side wall of said first cup a plurality of bosses formed on the interior of said collar adjacent the rim thereof.

5. A lid as claimed in claim 4 wherein said skirt of said collar is provided at the free end thereof with means adapted, in use, to lock or fasten said lid onto the rim of said second cup with which it is to be used.

6. A lid as claimed in claim 5 wherein said hole in said base portion is substantially circular.

7. A lid as claimed in claim 6 wherein said hole in said base portion has a downwardly turned skirt surrounding at least a portion of the periphery thereof.

8. A lid as claimed in claim 7 wherein said hole has a skirt totally surrounding the periphery thereof.

9. A lid as claimed in claim 8 wherein said base portion is inclined downwardly towards said hole formed therein.

* * * * *